US008375588B2

(12) United States Patent
Gringer

(10) Patent No.: US 8,375,588 B2
(45) Date of Patent: Feb. 19, 2013

(54) AUTOMATICALLY RETRACTING SAFETY CARTON CUTTER

(75) Inventor: Donald Gringer, New York, NY (US)

(73) Assignee: Allway Tools, Inc., Bronx, NY (US)

( * ) Notice: Subject to any disclaimer, the term of this patent is extended or adjusted under 35 U.S.C. 154(b) by 845 days.

(21) Appl. No.: 12/430,297

(22) Filed: Apr. 27, 2009

(65) Prior Publication Data

US 2010/0269348 A1 Oct. 28, 2010

(51) Int. Cl.
*B67B 7/00* (2006.01)
*B26B 3/06* (2006.01)
*B26B 1/00* (2006.01)

(52) U.S. Cl. ..... 30/2; 30/154; 30/162; 30/335; 30/337

(58) Field of Classification Search ..... 30/2, 151, 30/154, 158–161, 164, 335, 337, 162
See application file for complete search history.

(56) References Cited

U.S. PATENT DOCUMENTS

| | | | | |
|---|---|---|---|---|
| 2,119,045 | A | 5/1938 | Deitrich | |
| 2,245,096 | A | 6/1941 | Penney | |
| 2,336,284 | A | 12/1943 | Nelson | |
| 2,376,887 | A | 5/1945 | Walters | |
| 2,635,337 | A | 4/1953 | Mercy | |
| 2,679,100 | A | 5/1954 | Ehler | |
| 2,862,296 | A | 12/1958 | Anderson | |
| 2,874,462 | A * | 2/1959 | Benedict, Jr. et al. | 30/162 |
| 2,885,779 | A * | 5/1959 | Newkirk | 30/162 |
| 2,948,961 | A | 8/1960 | Ortner | |
| 3,107,426 | A | 10/1963 | Robinson, Jr. | |
| 3,192,624 | A | 7/1965 | Gringer | |
| 3,667,122 | A | 6/1972 | Black | |
| 4,005,525 | A | 2/1977 | Gringer | |
| 4,139,939 | A * | 2/1979 | Crooks | 30/2 |
| 4,331,355 | A * | 5/1982 | Okuno | 292/251.5 |
| 4,479,566 | A * | 10/1984 | Ishii | 188/1.12 |
| 4,686,740 | A * | 8/1987 | Ishii | 16/85 |
| D296,498 | S | 7/1988 | Collins | |
| 4,805,304 | A | 2/1989 | Knoop | |
| 4,817,284 | A | 4/1989 | Sacherman et al. | |
| 4,820,093 | A * | 4/1989 | Hirakui et al. | 410/107 |
| 4,835,865 | A * | 6/1989 | Knoop | 30/162 |

(Continued)

FOREIGN PATENT DOCUMENTS

| | | |
|---|---|---|
| GB | 2 085 789 | 5/1982 |
| WO | WO00/06347 | 2/2000 |

OTHER PUBLICATIONS

Allway Tools, Soft Grip Tools for Hard Hat Jobs, 2005,pp. 4-7.

(Continued)

*Primary Examiner* — Kenneth E. Peterson
*Assistant Examiner* — Samuel A Davies
(74) *Attorney, Agent, or Firm* — Gottlieb, Rackman & Reisman, P.C.

(57) ABSTRACT

A preferred embodiment of a safety carton cutter comprises a first frame member pivotably connected to a second frame member to form a housing. Inside the housing mounted on the first frame member is a blade receptacle having a latch, a blade carrier, a biasing member and a follower. The follower is adapted to communicate with a cam profile located on a cam in the first frame member. The configuration of the follower and cam profile provides an extending and retracting mechanism that keeps the blade in a constant exposed position before and during the cutting process, and then allows the blade to retract immediately after the cutting process is complete.

25 Claims, 15 Drawing Sheets

U.S. PATENT DOCUMENTS 5,022,156 A 6/1991 Kallens et al.
5,025,558 A 6/1991 Gilbert
5,036,591 A 8/1991 Cousins
5,121,544 A 6/1992 Gilbert
5,141,517 A 8/1992 Shutt
5,232,071 A * 8/1993 Kawanabe ..... 188/1.12
5,254,128 A * 10/1993 Mesa ..... 606/167
5,289,637 A 3/1994 Coffey
5,386,632 A 2/1995 Schmidt
5,391,177 A * 2/1995 Schwartz ..... 606/167
5,426,855 A * 6/1995 Keklak et al. ..... 30/162
5,433,004 A 7/1995 Thompson et al.
5,435,064 A 7/1995 Brookfield
5,501,382 A 3/1996 Webb
5,528,832 A 6/1996 Schmidt
5,545,175 A 8/1996 Abidin et al.
5,581,890 A 12/1996 Schmidt
5,613,300 A 3/1997 Schmidt
5,617,635 A * 4/1997 Berns ..... 30/162
5,813,121 A * 9/1998 Gringer ..... 30/162
5,890,290 A * 4/1999 Davis ..... 30/2
D411,429 S 6/1999 Gringer
D417,073 S 11/1999 Diener et al.
6,026,575 A 2/2000 Wonderley
6,044,562 A * 4/2000 Dillenbeck ..... 30/162
6,058,607 A * 5/2000 Gringer ..... 30/162
6,085,952 A 7/2000 Garland
6,148,520 A * 11/2000 Berns ..... 30/2
6,219,923 B1 4/2001 Adinisi et al.
D444,368 S * 7/2001 Wonderley ..... D8/99
6,263,577 B1 7/2001 Wonderley
6,286,215 B1 9/2001 Panaccione
6,317,986 B1 11/2001 Huang
6,349,473 B1 * 2/2002 Schmidt ..... 30/162
D455,900 S 4/2002 Tecson
6,415,514 B1 7/2002 Chun
D461,309 S 8/2002 Erickson et al.
6,438,849 B1 * 8/2002 Wonderley ..... 30/161
D462,514 S 9/2002 Rivera et al.
6,474,519 B1 11/2002 Cleveland
6,487,778 B1 * 12/2002 Gringer et al. ..... 30/162
6,550,144 B1 * 4/2003 Berns ..... 30/162
6,557,262 B1 * 5/2003 Clemence et al. ..... 30/156
6,832,438 B1 * 12/2004 Gringer et al. ..... 30/162
D506,311 S 6/2005 Nigh
6,964,100 B1 11/2005 Musland
7,022,128 B2 * 4/2006 Morawski et al. ..... 606/167
7,055,407 B2 * 6/2006 Gringer et al. ..... 76/104.1
D527,241 S 8/2006 Davis et al.
D529,780 S 10/2006 Davis et al.
D533,343 S 12/2006 Gringer
7,322,110 B2 * 1/2008 Hernandez et al. ..... 30/162
7,325,313 B2 * 2/2008 Gringer et al. ..... 30/162
7,356,928 B2 4/2008 Votolato
7,596,869 B2 * 10/2009 Berns ..... 30/162
7,603,779 B2 * 10/2009 Rowlay ..... 30/162
7,765,701 B2 * 8/2010 Okada ..... 30/162
7,891,098 B2 * 2/2011 Parker et al. ..... 30/162
8,028,421 B2 * 10/2011 Johnson et al. ..... 30/162
2003/0159290 A1 * 8/2003 Berns ..... 30/2
2004/0045167 A1 3/2004 Gringer et al.
2005/0097753 A1 5/2005 Gringer et al.
2005/0097756 A1 * 5/2005 Gringer et al. ..... 30/162
2005/0172496 A1 * 8/2005 Zeng ..... 30/151
2005/0279787 A1 12/2005 Davis et al.
2007/0209209 A1 * 9/2007 Davis et al. ..... 30/162
2009/0277016 A1 * 11/2009 Wu ..... 30/162
2010/0269348 A1 * 10/2010 Gringer ..... 30/2
2010/0319200 A1 * 12/2010 Davis et al. ..... 30/162
2011/0232104 A1 * 9/2011 Ho ..... 30/162

OTHER PUBLICATIONS

OLFA Products, Safety Cutters & Blades, www.olfa.com, 2007.
Lewis Knives, Knives and Blades, 2007, p. 5.
Pacific Handy Cutter, Safety First System, Store Supply Safety Catalog, 2004.
Olo Safety Carton Cutter, Division of World Kitchen, Inc., Flyer, 2007.
Stanley Hand Tools, Knives, Fixed Blades, The Stanley Works, 2005.
"LAMP" Magnetic Latch, pp. 1&2.

* cited by examiner

AUTOMATICALLY RETRACTING SAFETY CARTON CUTTER

FIELD OF INVENTION

The present application relates generally to an improved safety carton cutter having a retracting mechanism that automatically retracts the blade immediately after use, thereby reducing the risk of serious injury to a user and bystanders.

BACKGROUND OF THE INVENTION

Carton cutters and other forms of cutting instruments are used in connection with a number of activities, including box cutting, cutting of corrugated materials and packaging and a host of other tasks. U.S. Pat. No. 2,679,100 illustrates one form of knife which incorporates a two-piece housing having a cavity in which a blade is secured. The two housing sections are releasably secured to each other using a fastening screw, and the blade remains exposed in a fixed position during use. When the blade becomes dull, the user removes the fastening screw, separates the housing sections and inserts a new blade in place of the dull one. U.S. Pat. No. 2,635,337 discloses a notched linoleum cutting knife that incorporates a one-piece handle and a fixed blade. Both of these cutting devices (as well as others not specifically described herein) have exposed blades that can be hazardous and result in injury to users who are not particularly careful. For example, an unsuspecting person can be inadvertently cut by the exposed blade upon attempting to retrieve the knife from a storage container.

In addition, there are potential hazards associated with the transport of fixed-blade utility knives. Prior to transport, a user must cover the sharp edge or remove the blade to reduce the risk of harm from the blade. This can result in delays if done properly, or injury if a user simply decides to leave the blade exposed.

The dangers associated with exposed, fixed blade knives have resulted in significant improvements in the field and, in particular, in knives with a selectively retractable blade. See e.g., U.S. Pat. No. 2,862,296, U.S. Pat. No. 2,948,961, and U.S. Pat. No. 3,107,426. In such knives, the blade is disposed within the housing and is selectively extended and retracted by engaging an external member. The external member actuates a carriage which carries the blade, allowing a user to extend and retract the blade as desired.

Despite the improvements associated with cutting devices having retractable blades, there still exist other potential hazards. For example, for a knife having a retractable blade, if that blade is left exposed in an extended position, it could still result in injury. In addition to the inadvertent injuries that can potentially result from a blade left in the exposed position, other potentially more severe injuries can occur soon after a cutting stroke as applied to a box or the like is complete, when the blade is traveling at a relatively higher speed. For example, depending on the material being cut, a high drag force on the blade is often produced, causing a user to compensate by applying greater force in order to complete the cutting stroke through the material. The forces that are applied can cause the knife and the exposed blade to leave forward, that is, to accelerate beyond control just as the cut through the material is completed. At this point, the drag force is no longer present and the user holding the knife with the exposed blade cannot manually react quickly enough to stop the acceleration of the blade. This can potentially result in injuries even more severe than those sustained by virtue of a utility knife fixed in place.

Some utility knives have incorporated automatically retractable blades, such as U.S. Pat. No. 5,813,121, wherein the blade automatically retracts once pressure on the actuating button is released and the cut is completed. At the beginning of and during the cutting process using this form of cutting device, a user's thumb must remain in place on the actuating button to prevent the blade from retracting at the initiation of the cut. However, as the cutting process comes to a conclusion, a user may not be able to react quickly enough to release the actuating button, thereby potentially resulting in a similar injury discussed above.

Attempts to produce a utility knife to mitigate the aforementioned drawbacks include U.S. Pat. No. 7,356,928 ("Votolato"). Votolato discloses a cutting device having a fixed blade with a spring loaded safety guard that covers the blade. When a cut is desired, a user depresses a trigger that allows the guard to rotate and expose the blade for a single use. After the single use, the guard rotates back to a locked position, shielding the blade, regardless of whether the trigger remains depressed.

Despite addressing some of the drawbacks associated with prior art utility knives, a number of issues persist. For example, if excessive force is applied to the guard prior to depressing the trigger, the mechanism may break, thereby undesirably exposing the blade and essentially leaving a user with utility knife having a fixed blade. The same can result if the guard is damaged from dropping the knife, or the guard is worn from corrugated friction.

Another drawback in the form of a cutting instrument disclosed in Votolato is that such instruments have an inherently reduced degree of accuracy. To begin a cut at a precise point, the tip of a blade generally needs to be at least somewhat exposed so that it can manually be placed by a user at a desired location. In a cutting instrument with a blade guard like the one disclosed in Votolato, the blade is hidden, requiring a user to approximate, that is, guess at the exact location where the blade will begin to cut. This feature prevents a user from aligning the tip of the blade at a precise location, (e.g., a reference mark), thereby possibly resulting in inaccurate cuts, damage to merchandise, waste of materials and the like. In some instances, a user would be required to reposition the utility knife several times until the desired position is found.

Furthermore, using the form of cutting instruments disclosed in Votolato presents another related problem when attempting to cut with the aide of a guide. For example, in order to make a straight cut through corrugated material, a straight guide is placed precisely along a line to be cut and the side of the blade is aligned with the guide during the entire cut. This cannot be accomplished using the utility knife disclosed in Votolato because the guard would at least initially obstruct the blade from starting at the desired location beside the guide.

SUMMARY OF THE INVENTION

In view of the deficiencies and drawbacks in the prior art, it is a primary object of the present invention to provide a safety carton cutter having a blade that is automatically held in a constant exposed position during the cutting process, and is retracted immediately after the cutting process is complete.

Another object of the present invention to provide a safety carton cutter having a blade that is automatically retractable to ensure that the blade is safely positioned after use.

Yet another object of the present invention is to provide a carton cutter that is safe, yet can also cut accurately.

Additional objectives will be apparent from the description of the invention that follows.

In summary, there is provided in a preferred embodiment of the present invention an improved safety carton cutter having an automatically retractable blade. In the safety carton cutter, after the blade is moved forward into an extended position by applying force with a user's finger to an actuator or latch, the blade is held in the extended position ready to cut even after the user's finger is removed from the actuator. Then, once the cutting process is complete, the blade automatically retracts as the frictional pulling force on the blade is released. Generally, after being moved into an open position, the blade of the device remains extended like that of blade in a conventional utility knife. However, when a cut is complete in connection with a frictional material, such as corrugated board, the blade automatically retracts to a safe position.

The preferred embodiment of the carton cutter comprises a housing having a first frame member and a second frame member. A blade carrier or receptacle contained in the housing carries a blade and is connected to a biasing member. The biasing member urges the blade receptacle into a retracted or closed position. On either side of the blade receptacle is an actuator or latch which allows the sliding of the blade receptacle together with the blade. Contained within the housing is a mechanism, described in more detail below, that enables the blade to remain in an extended position during the cutting process, and is configured and arranged to automatically retract the blade receptacle upon completion of a cutting motion.

BRIEF DESCRIPTIONS OF THE DRAWINGS

The above-described and other advantages and features of the present disclosure will be appreciated and understood by those skilled in the art from the following detailed description and drawings of which FIG. 1 is a perspective view of a first preferred embodiment of a safety carton cutter made in accordance with the present invention.;

DETAILED DESCRIPTION OF THE INVENTION

Figure 1:
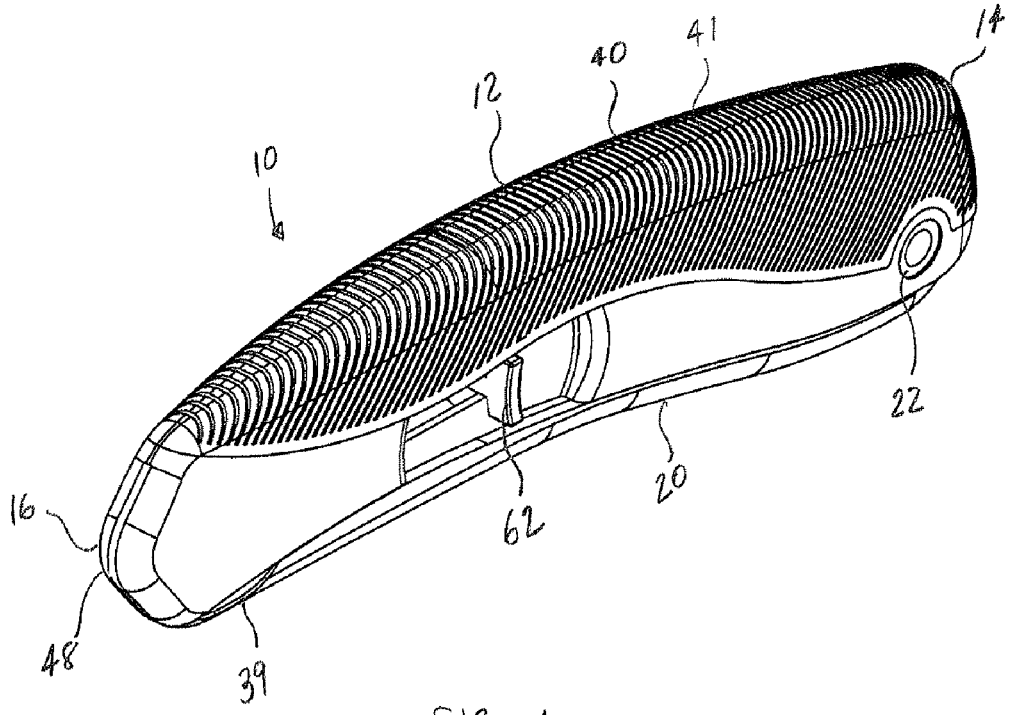

With reference to FIGS. 1 through 22, there is shown a preferred embodiment of an improved safety carton cutter 10. Generally, the carton cutter 10 has a housing 12 comprised of a lower or first frame member 20 and an upper or second frame member 40 having a cover or gripping surface 41. The cover 41 is preferably fitted into a recess on the second frame member 40 and is intended to aid in handling of the carton cutter 10 by a user. Preferably, the cover 41 is formed of an elastomer such as rubber, silicone, thermoplastic elastomer or other suitable material(s), and is over molded onto second frame member 40. Optionally, the cover 41 can be fabricated separately and then bonded to the second frame member 40 using a conventional adhesive.

Figure 2:
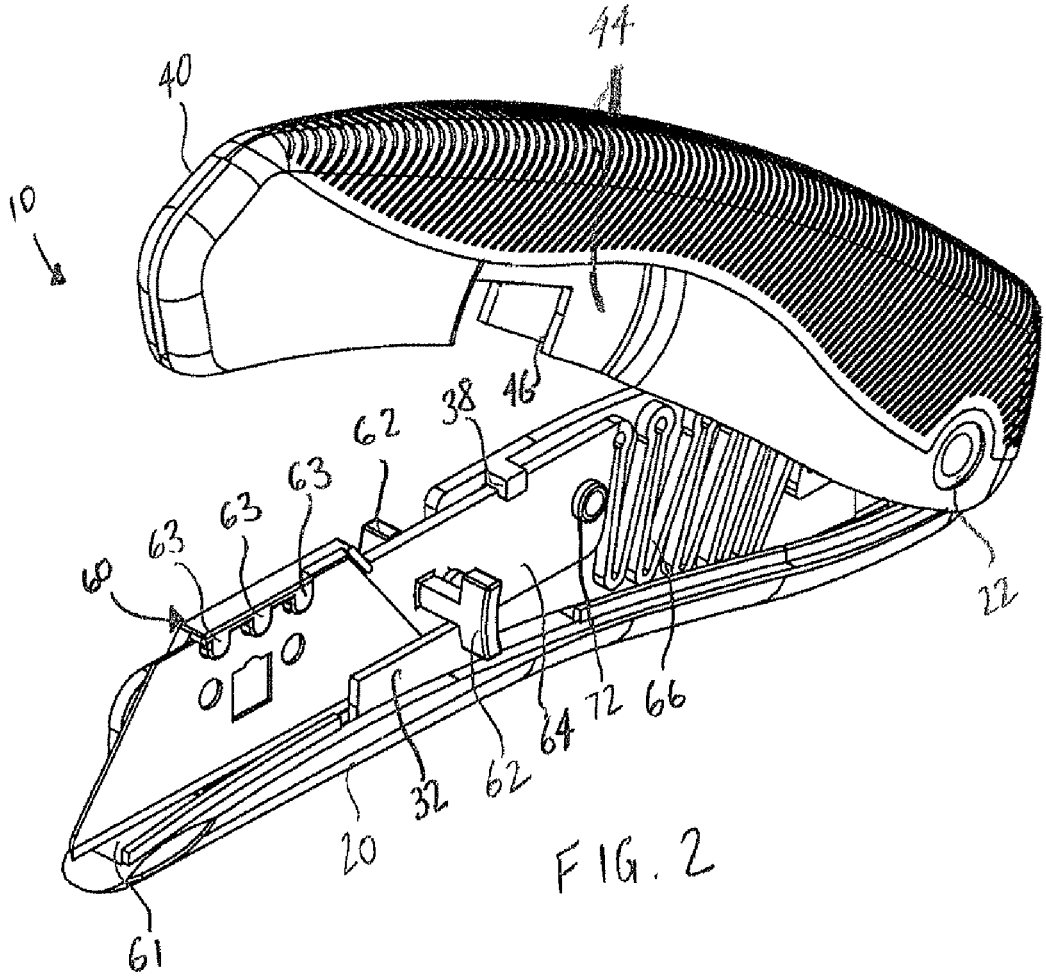
FIG. 2 is an isometric view illustrating the left side of the safety carton cutter shown in FIG. 1, with the second frame member shown in an open or rotated position relative to the first frame member.
Figure 3:
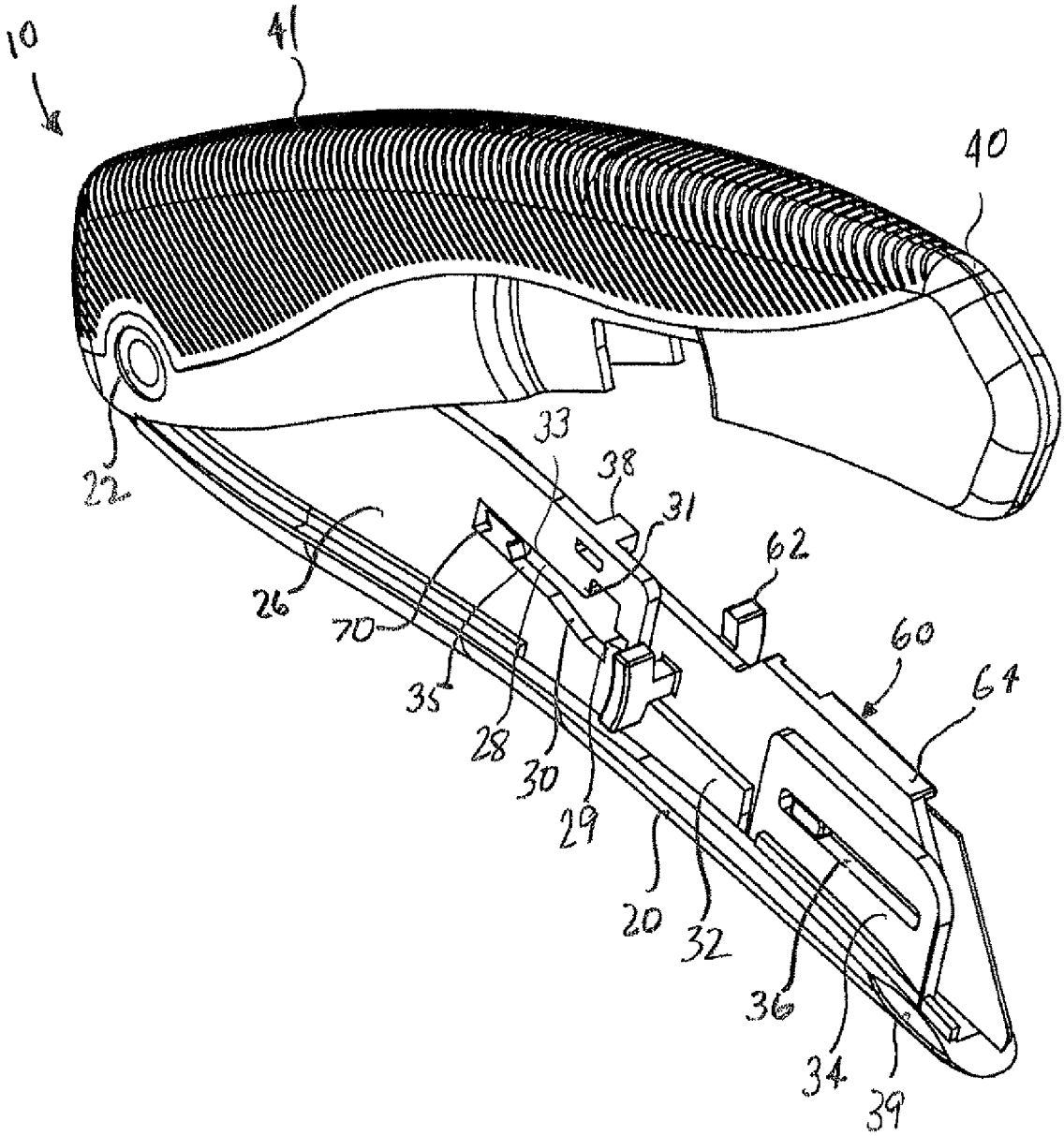
FIG. 3 is an isometric view illustrating the right side of the safety carton cutter shown in FIG. 1, with the second frame member shown in an open or rotated position relative to the first frame member.
Figure 4:
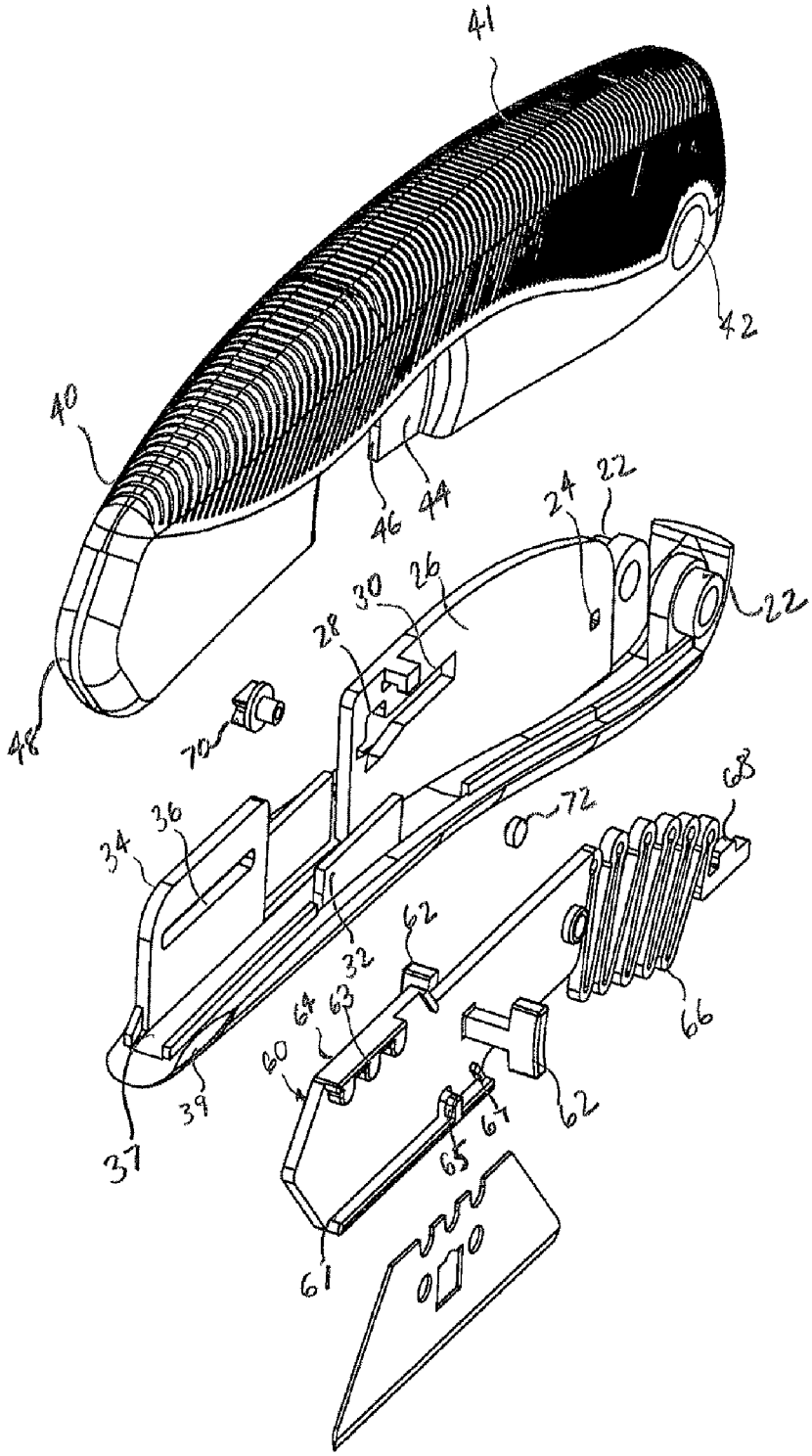
FIG. 4 is an exploded view of the safety carton cutter.
Figure 5:
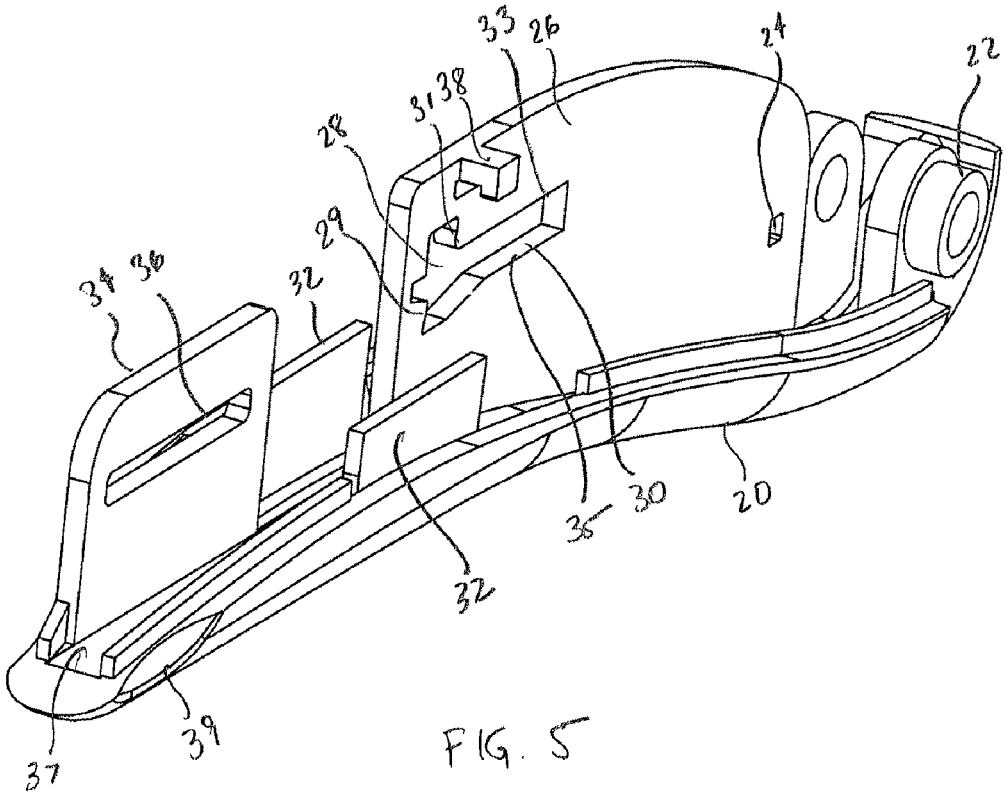
FIG. 5 is an isometric view illustrating the left side of the first frame member of the safety carton cutter.
Figure 6:
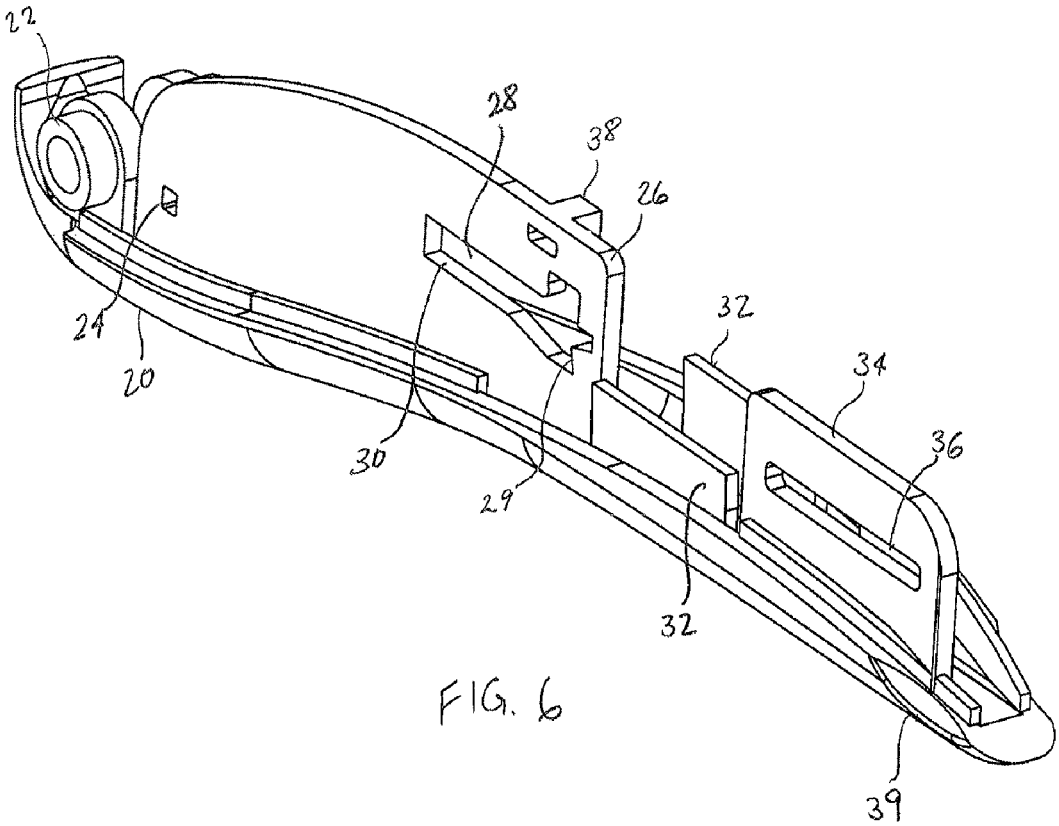
FIG. 6 is an isometric view illustrating the right side of the first frame member of the safety carton cutter.
Figure 7:
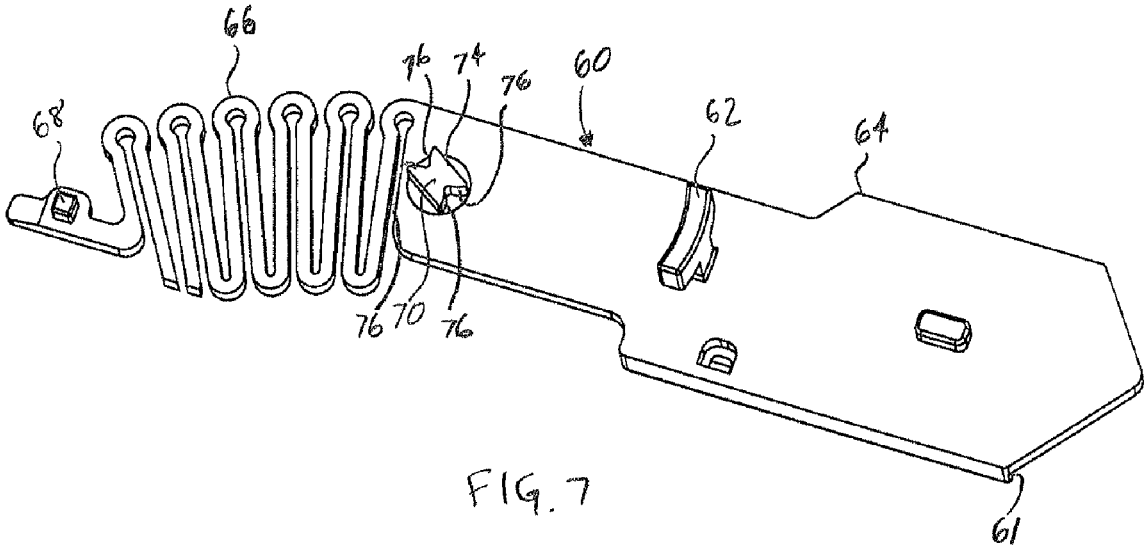
FIG. 7 is an isometric view illustrating the right side of the blade receptacle of the safety carton cutter.

The first frame member 20 and the second frame member 40 are pivotably secured to one another at the rear end 14 of the carton cutter 10 with a pair of frame bosses 22, 22. Each frame boss 22, 22 is aligned with a pivoting aperture 42, 42 located on either side of the second frame member 40. This connection allows the second frame member 40 to pivot with respect to first frame member 20 as illustrated in FIG. 2 and FIG. 3. Preferably, the second frame member 40 is able to flex over the first frame member 20, wrapping around frame bosses 22, 22. The second frame member 40 can also optionally be configured to fit over first frame member 20 such that an affixing pin may be inserted to secure the first frame member 20 to the second frame member 40 after aligning the frame bosses 22, 22 with the respective apertures 42, 42. In addition to the foregoing, it should be understood that the first frame member and second frame member can be modified and assembled as shown in U.S. Pat. No. 6,058,607, the contents which are incorporated by reference.

The first frame member 20 is preferably formed of die cast zinc or aluminum. However, it should be understood that other materials are suitable for forming the first frame member 20, such as acetal, nylon, other hard plastics, steel, brass, and/or other materials that are known in the art. Second frame member 40 is preferably formed of a molded plastic material, such as acetal, nylon or polycarbonate. It should be understood that the second frame member can also be made from the same materials mentioned above in connection with the first frame member.

As shown in FIG. 2 and FIG. 3, mounted on the first frame member 20 is a blade receptacle 60. The blade receptacle 60 is also shown apart from the first frame member 20 in FIG. 4, FIG. 7 and FIG. 8. The blade receptacle 60 is positioned in sliding engagement with the first frame member 20, which allows the blade receptacle 60 (and a blade positioned in the blade receptacle 60) to transition between an extended position and a retracted position within the housing 12 when force is applied to one of two finger actuators or latches 62, 62 located on either side of the blade receptacle 60. The finger latches 62, 62 are symmetrically positioned and enable use of the carton cutter 10 by both right- and left-handed users. The blade receptacle 60 comprises a carrier member 64 and a biasing member 66 that are integrally molded to one another from conventional hard plastic, using an injection molding process. In a preferred embodiment, the biasing member 66 has a serpentine configuration. At the rear end of the biasing member 66 is a retainer 68 in the form of a raised post which is inserted as an anchor into a suitably fitted aperture or slot 24 on the first frame member 20. When force is applied to move the blade receptacle 60 into an extended position which stretches the biasing member 66, there is an opposing force that urges the blade receptacle 60 rearward into a retracted position. It should be understood the biasing member may optionally be constructed separate from the carrier member and from different materials, and subsequently joined thereto by heat staking, ultrasonic welding or other means known in the art. Likewise, a conventional extension coil spring attached to the carrier member may be utilized as a biasing member instead of an integrally molded biasing member. Those skilled in the art can also appreciate that coil springs may be formed out of materials such as music wire, stainless steel wire, copper and bronze.

Figure 8:
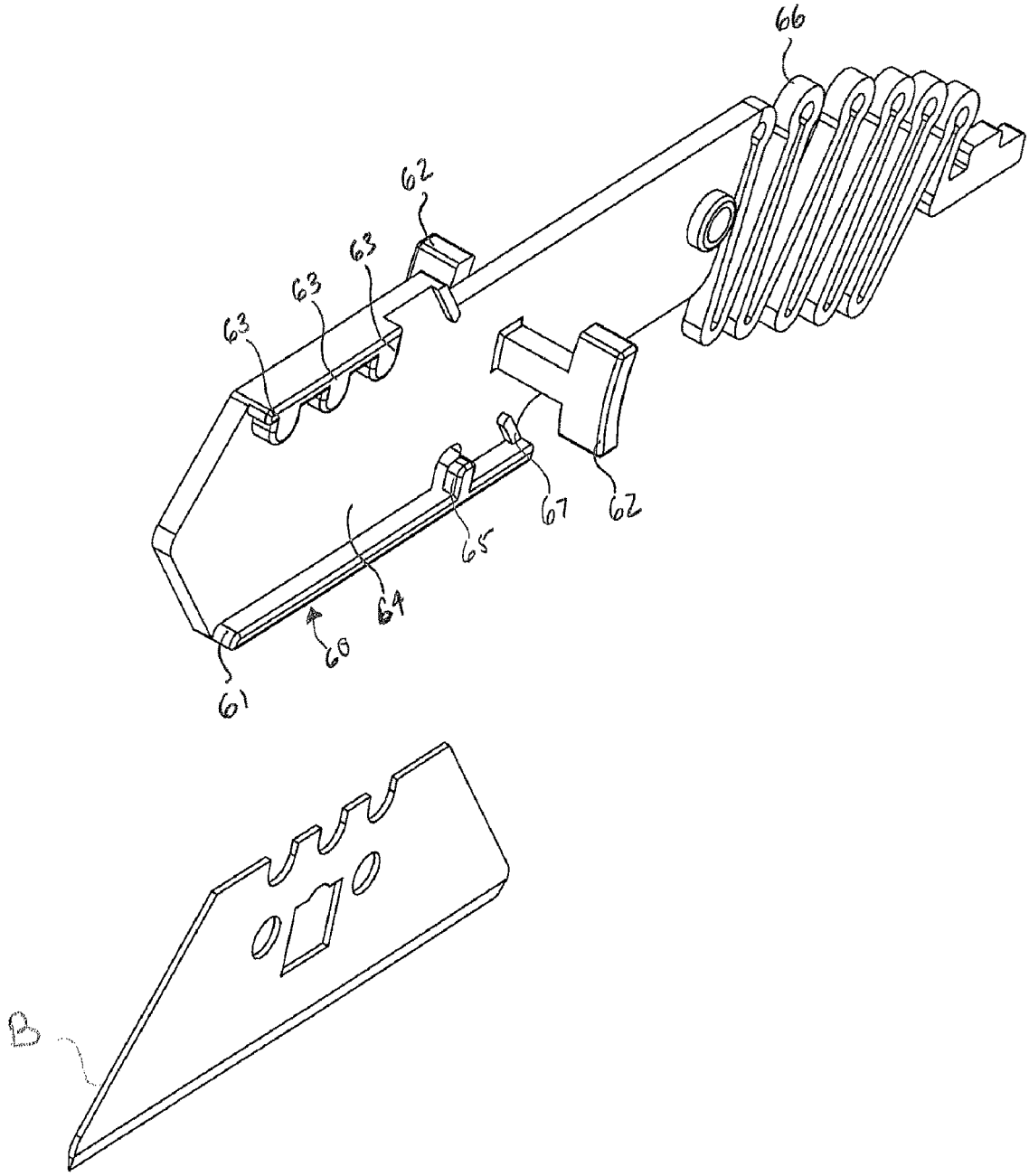
FIG. 8 is an isometric view illustrating the left side of the blade receptacle of the safety carton cutter with the blade removed therefrom.

As shown in FIG. 8, the blade receptacle 60 contains a ledge or perch 61, a plurality of upper blade guides 63 which fit into recesses of conventional blades B and a lower blade guide 65 at the base of the blade receptacle 60 which together align and maintain the blade in an upright, cutting position. Lower blade guide 64 forms a narrow void which facilitates the assembly of the blade receptacle 60 and the blade. Blade stop 67 located rearward of the lower blade guide 65 further helps in the assembly of the blade receptacle 60 and blade, and the retention of the blade when it is subjected to forces resulting from use of the carton cutter 10.

The first frame member 20 has a vertically oriented cam 26, having a slot 28 which forms a cam edge or profile 30. The cam profile 30 communicates with a rotating projection or follower 70 that is positioned on the blade receptacle 60 and secured with a fastener 72 that is configured to be press fitted into a bore 73, resulting in a loose friction fit that permits the follower 70 to rotate as needed. As shown most clearly in FIG. 10 and FIG. 12, the follower 70 generally has an hourglass configuration, with two flat surfaces 74, 74 and four curved surfaces 76, 76, 76, 76, the four curved surfaces 76, 76, 76, 76 forming two inwardly-oriented V's. As will be described below in more detail, surfaces 74, 74, 76, 76, 76, 76 communicate with cam profile 30 in order to keep the cutting blade in an exposed position during the cutting process, and then to retract the cutting blade immediately after the cutting process is complete.

The action described in connection with the safety carton cutter 10 occurs if the user's finger is released from the actuator 62, 62 after the blade is shifted to an extended position but before the cutting process commences (or even at some time during the cutting process), such that manual force from the user is not applied to keep the blade extended. In this regard, the safety carton cutter 10 is similar to a utility knife having a blade that remains extended even when a finger is removed from the button that extends the blade forward. The difference, however, is that the blade retracts as soon as the cut is complete. As discussed below in more detail, this is made possible in part by the frictional forces pulling the blade forward a fraction of an inch as the carton cutter makes a cut. In that regard, the safety carton cutter 10 is a hybrid cutting device having the best of both non-automatically and automatically retractable cutting devices.

The first frame member 20 has a number of additional features that contribute to the smooth and efficient operation of the carton cutter 10. For example, the first frame member 20 has a pair of guides 32, 32 that each provide support to finger latches 62, 62 located on either side of the blade receptacle 60. The first frame member 20 also has blade guide 34 which provides vertical support to the blade receptacle 60 and also serves to impede forward movement of the blade receptacle 60 when the finger latches 62, 62 come in contact with the rear of the guide 34. Preferably, the blade guide 34 incorporates a horizontal slot 36 which provides additional support to the blade receptacle 60 and helps ensure that the blade receptacle 60 proceeds in a straight line as forward pressure is applied to either one of the latches 62, 62. Additional support at the bottom surface of the blade receptacle 60 is provided internally by a track 37 at the bottom of the first frame member 20. At the front end 16 of the carton cutter 10 are two dimples 39,39 located on either side of the first frame member 20. The dimples 39, 39 give users who desire to access the interior of the housing a place to grip the first frame member 20 so that it can be rotated relative to the second frame member 40. A retention ear 38 provided on the first frame member 20 ensures that blade receptacle 60 remains slidably engaged to and does not significantly shift laterally, away from the cam 26. The retention ear 38 can be made of a resilient material and partially deform during assembly of blade receptacle 60 resulting in an assembly that stays fixed as needed. One of ordinary skill can appreciate that retention ear 38 can be substituted by an alternate mechanical fastener such as a shoulder screw or spring clip. One of ordinary skill can also appreciate that retention ear can be bonded or welded onto a first frame member after the attaching of a blade receptacle.

Figure 9:
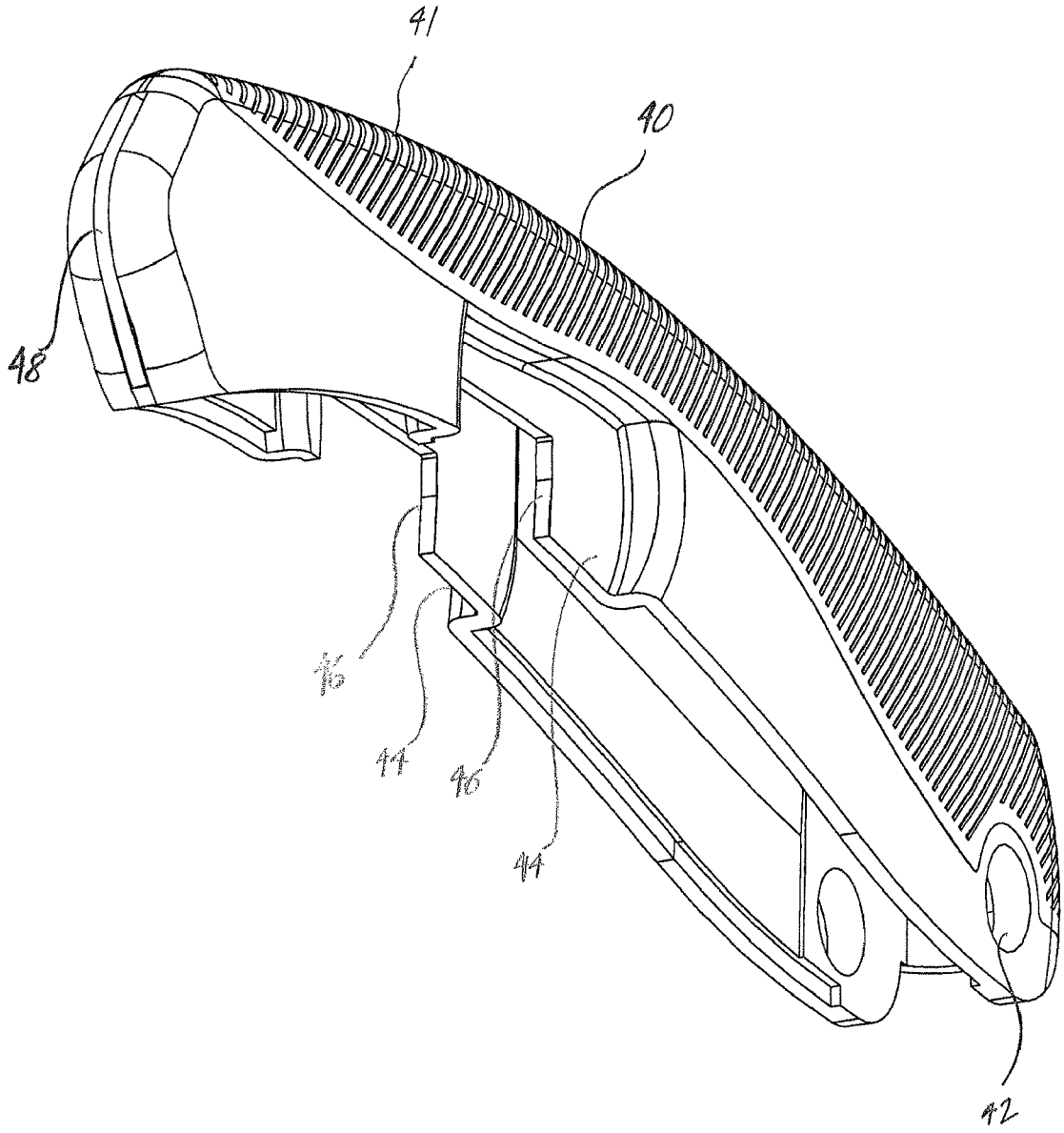
FIG. 9 is an isometric view of the second frame member of the safety carton cutter.
Figure 10:
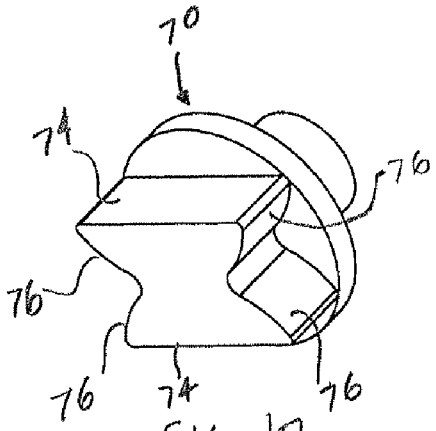
FIG. 10 is an isometric view illustrating the front of the follower of the safety carton cutter.
Figure 11:
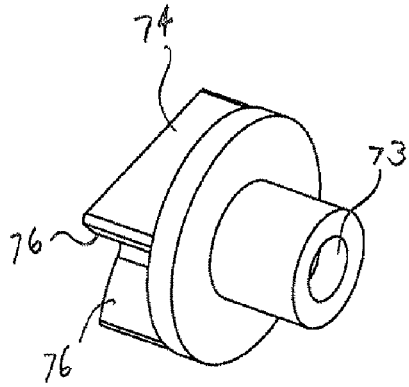
FIG. 11 is an isometric view illustrating the rear of the follower.
Figure 12:
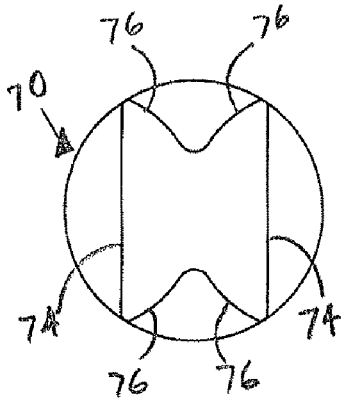
FIG. 12 is a top plan view of the follower.

As shown most clearly in FIG. 2 and FIG. 9, second frame member 40 incorporates two steps 44, 44 indented into the left side and right side of the second frame member 40. In the vicinity of each step 44, 44, is a body recess 46, 46. The steps 44, 44 and recesses 46, 46 together provide the necessary clearance for the finger latches 62, 62 to freely move as needed. Second frame member 40 further comprises an opening 48 at the front end thereof which permits exposure of the blade when the blade receptacle 60 is pushed forward.

Some physical principles involving utility knives and their use are of particular interest here prior to discussing the internal workings of the carton cutter 10 in more detail. When materials are cut using a sharp blade, the edge of the blade is generally forced into the work piece, forcing the material that is being cut away from the cutting edge. When this occurs, the material from the work piece is pressed on both sides of the blade and remains in the compressed state against either side of the blade. Using basic equations, the frictional force between the sides of the blade and the work piece can be determined using the equation $F_f=\mu N$, where $F_f$ is the frictional force, $\mu$ is the coefficient of friction between the work piece and the sides of the blade, and N is the normal force against the sides of the blade from the work piece. Due to the frictional force between the sides of the blade and the work piece, there exists a force on the blade that the user must overcome to withdraw the blade from the work piece. It is this force that is of particular interest in that when the user applies a removing force, another force pulls on the blade, urging it forward in the general direction that the blade proceeds as it is extended into an exposed position.

Figure 14:
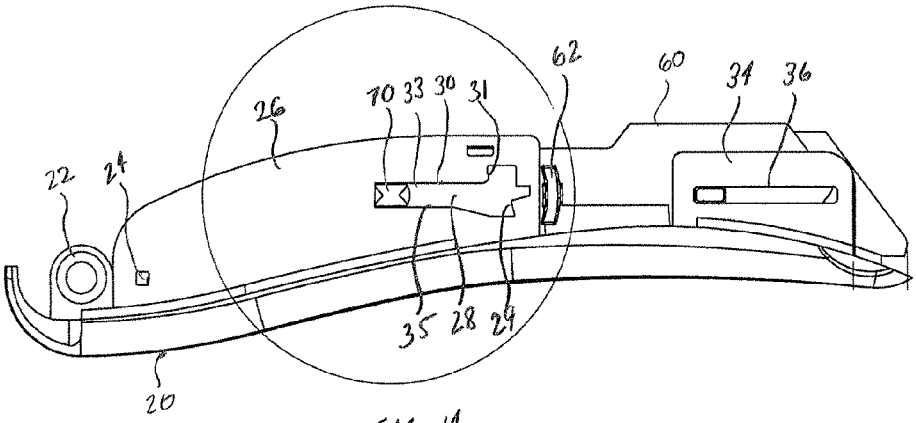
FIG. 14 is a plan view illustrating the right side of the first frame member and blade receptacle when the blade is in a retracted or closed position.
Figure 15:
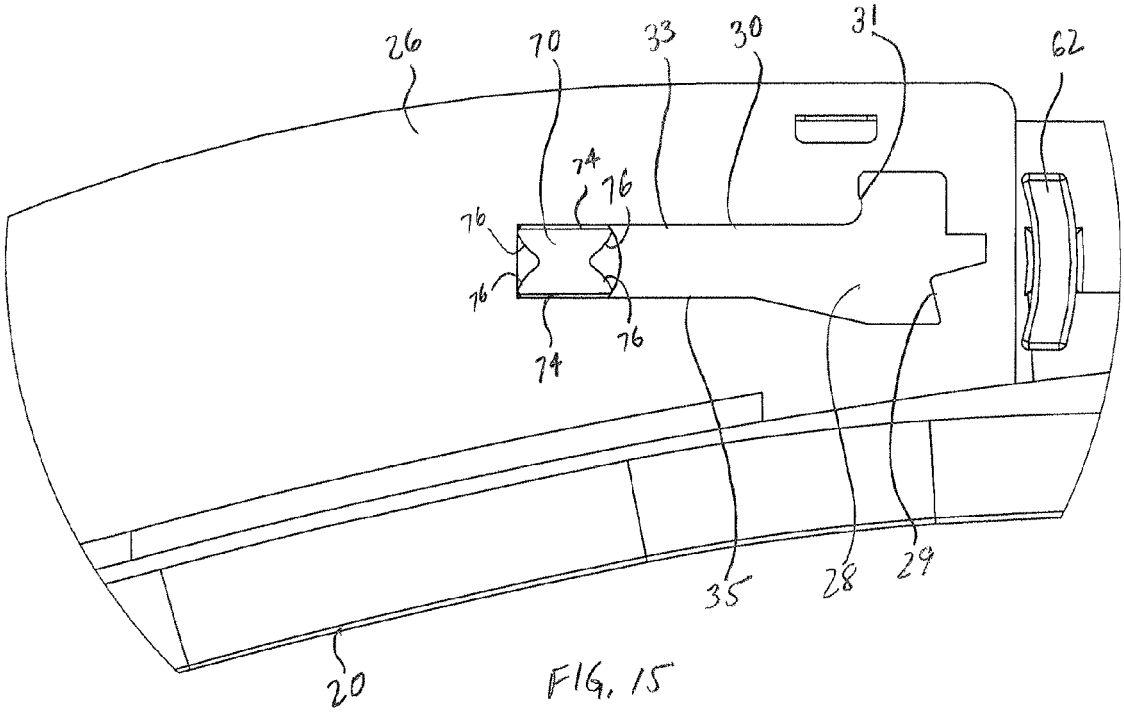
FIG. 15 is a magnified view taken from a selected area of FIG. 14.
Figure 16:
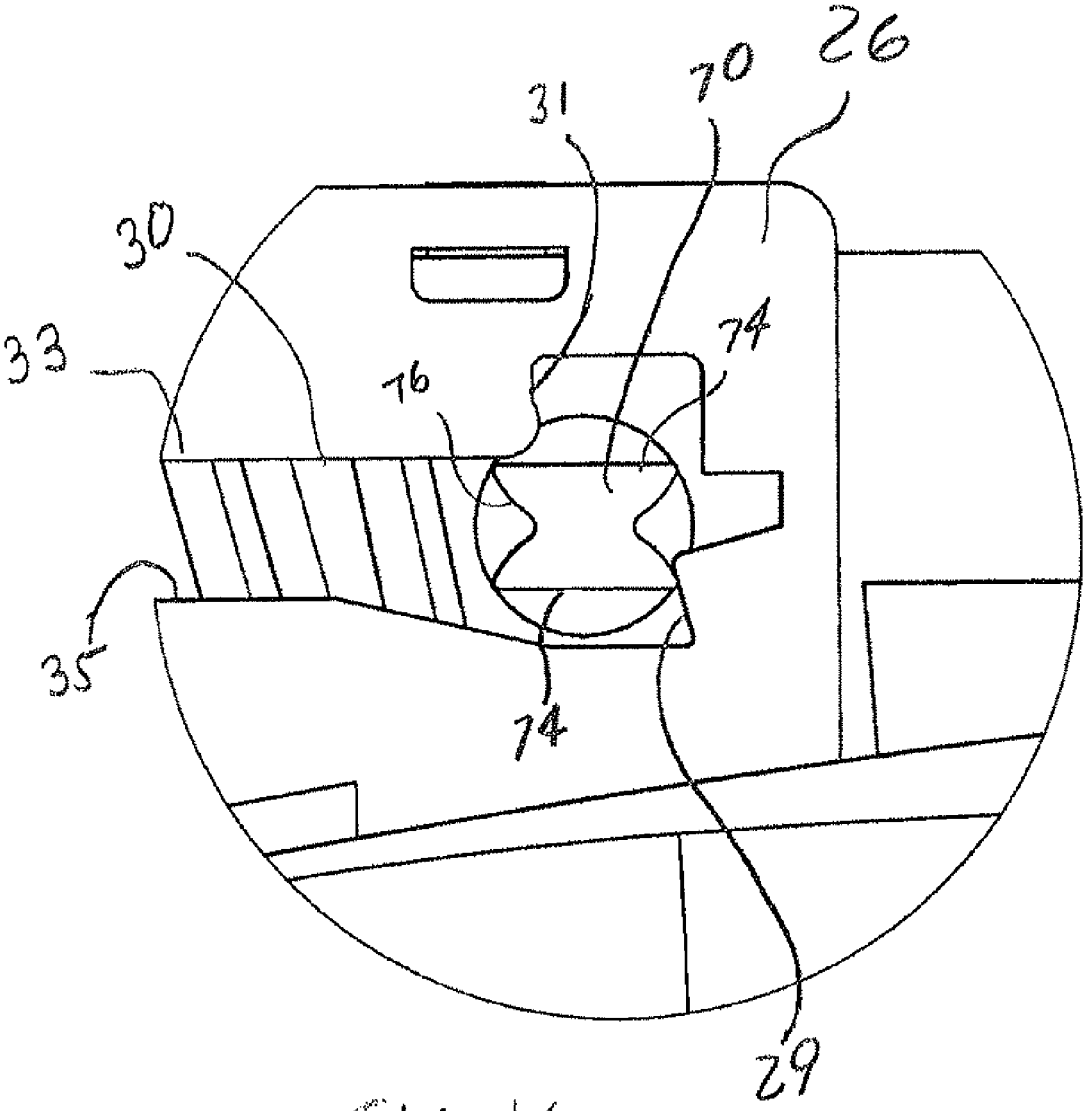
FIG. 16 is a magnified view showing the position and orientation of the follower as the blade is moved into an extended position.

With the foregoing physical principles in mind, it is helpful to describe the carton cutter 10 being operated in accordance with phases that make up a cycle. FIG. 1 illustrates the carton cutter 10 in a closed, resting or retracted position, which is the beginning of phase one of the cycle. The closed position is defined when the blade is retracted inside the carton cutter 10. Retraction of the blade is made possible by the biasing member 66 which urges the blade receptacle 60 into the closed position. In the retracted position, the follower 70 is positioned at the rear of the slot 28 of the cam 26 along cam profile 30, as shown in FIG. 14 and FIG. 15. During phase one, a user applies force to one of the latches 62, 62 moving it (and the blade receptacle) forward. The follower 70 is configured to be in a loose friction fit to blade receptacle 60, with the parallel surfaces 74 on the follower 70 continuing along as the receptacle 60 is moved forward. Eventually, internal surface 76 of the follower 70 makes contact with the front of the slot 28 in the cam 26 at surface 29 of cam profile 30. The contact of the follower 70 and surface 29 signals the completion of phase one and the start of phase two.

Figure 17:
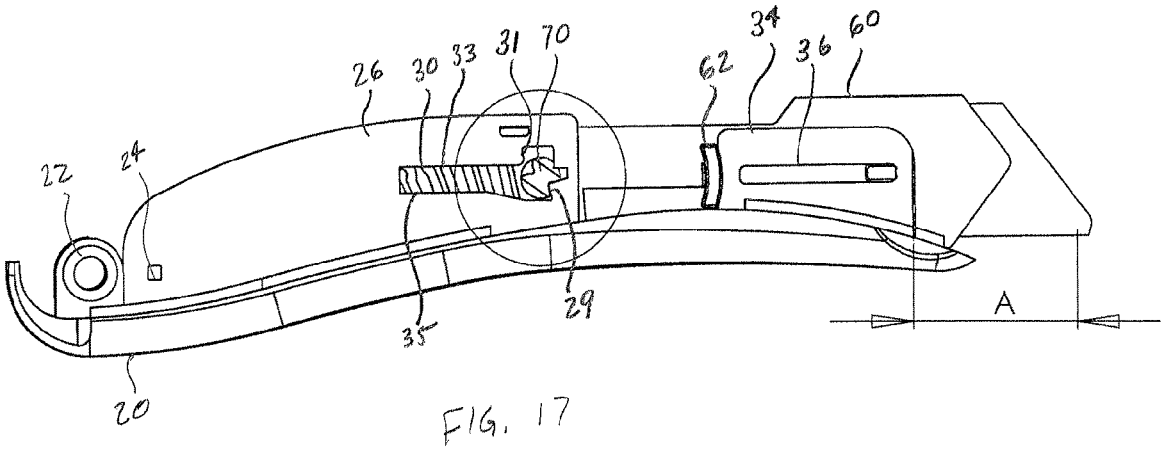
FIG. 17 is a plan view illustrating the right side of the first frame member and blade receptacle as the blade is placed in an extended or open position.
Figure 18:
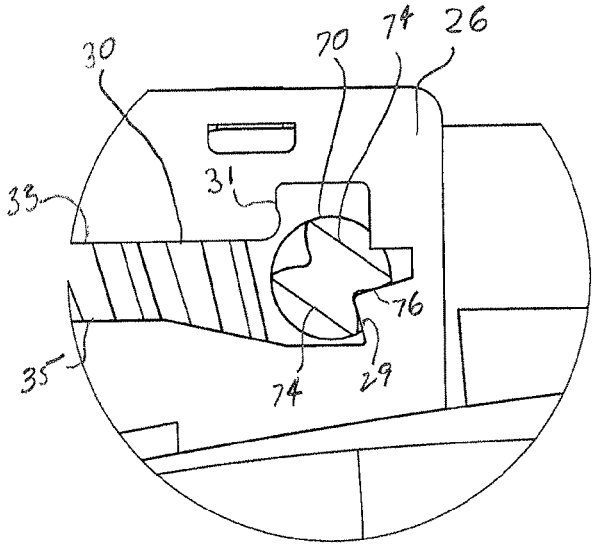
FIG. 18 is a magnified view taken from a selected area of FIG. 17.

With continued forward force applied by a user to a latch 62, the follower 70 beings to rotate clockwise approximately 35-45 degrees, and stops as shown in FIG. 17 and FIG. 18. This event should preferably coincide with one or both of the latches 62, 62 making contact the inner surface of the steps 44, 44 of the second frame member 40, and one or both of the latches 62, 62 contact the rear of the blade guide 34. At this point, the blade is in a fully extended position measured by dimension A, shown in FIG. 17. This signals the completion of phase two and the start of phase three.

Figure 13:
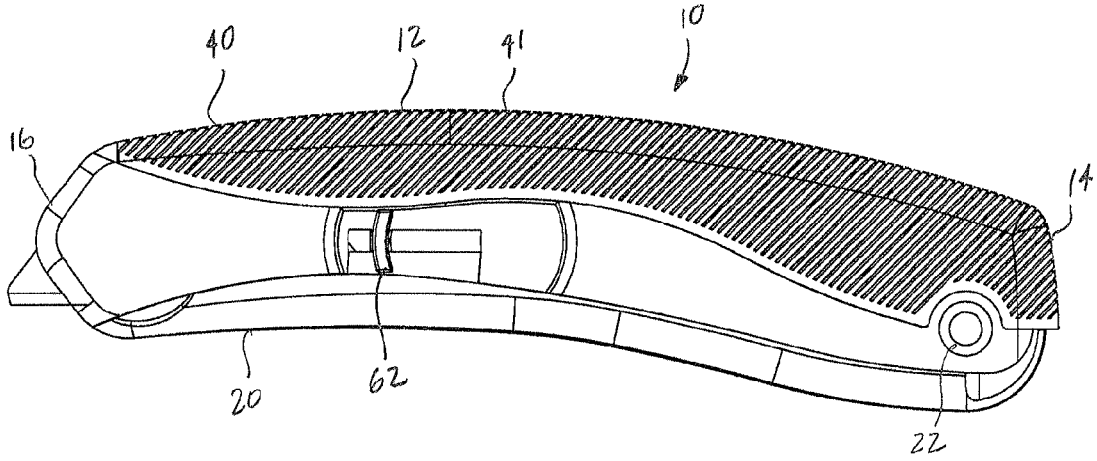
FIG. 13 is a plan view of the safety carton cutter of FIG. 1 with the blade shown in an extended or open position.
Figure 19:
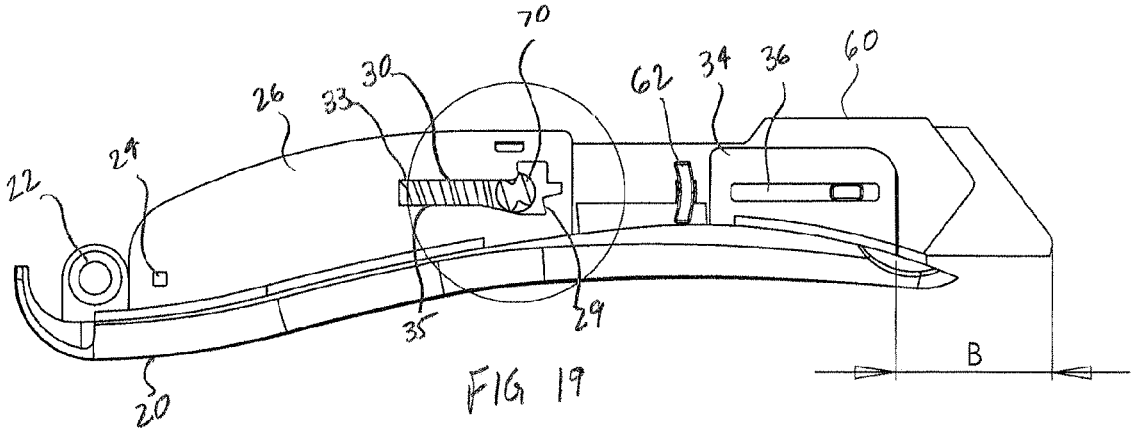
FIG. 19 is a plan view illustrating the right side of the first frame member and blade receptacle as the follower rests in the engaged position.
Figure 20:
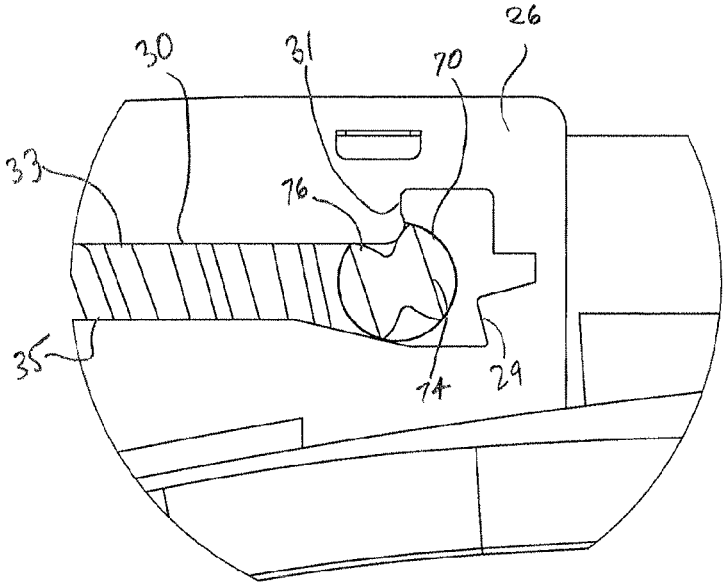
FIG. 20 is a magnified view taken from a selected area of FIG. 19.

When the user removes the forward sliding force, blade receptacle 60 and biasing member 66 retract rearward. With no additional forward force applied by a user to a latch 62, the follower 70 continues to rotate clockwise and stops as shown in FIG. 19 and FIG. 20. The continued rotation of the follower 70 occurs as a result of the biasing spring's rearward pull and corner 31 of cam profile 30. The rotation and rearward movement stops as follower 70 becomes lodged in the slot 28. Thus, as the biasing spring 66 continues to urge the receptacle 60 rearward, the blade retracts somewhat but still remains extended in a suitable cutting position as shown in FIG. 13. At this point, the blade is in an extended position measured by dimension B, shown in FIG. 19, which is less than dimension A. With no additional intervention from the user, the carton cutter 10 remains in a cutting position and the user has the ability to accurately place the tip of the blade in a desired location of the work piece or item to be cut. This signals the completion of phase three and the start of phase four of the cycle.

Figure 21:
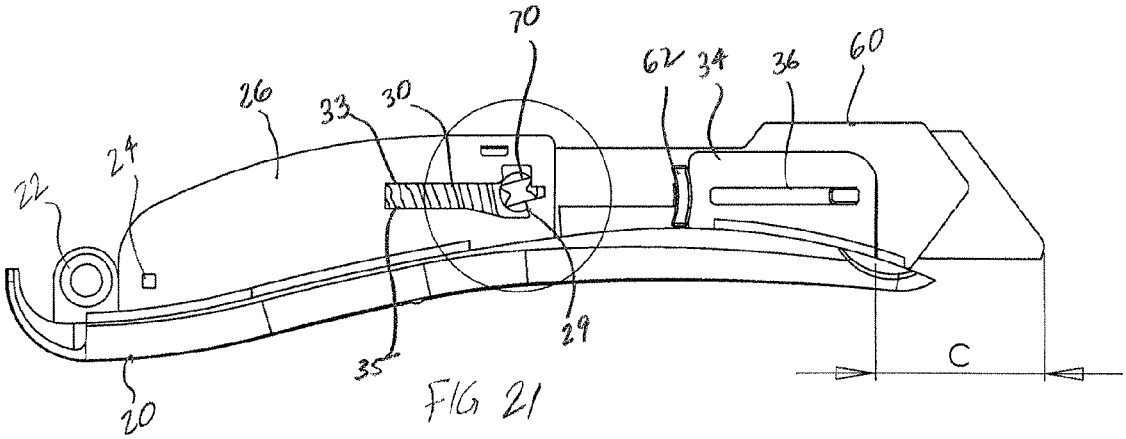
FIG. 21 is a plan view illustrating the right side of the first frame member and blade receptacle as the follower rotates into a disengaging or reset position.
Figure 22:
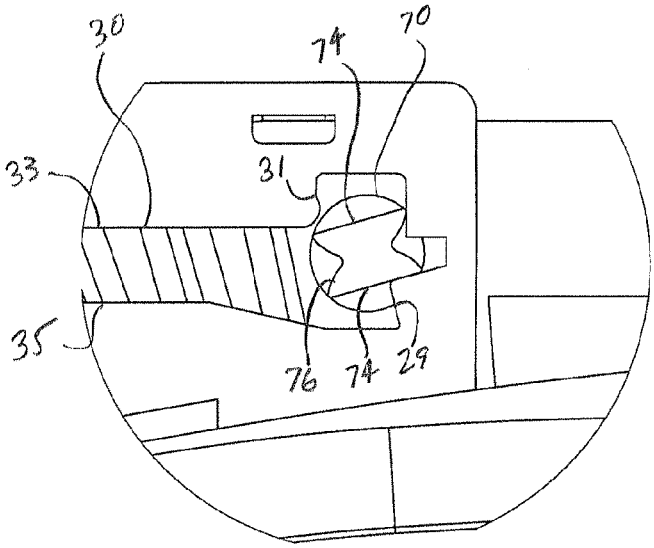
FIG. 22 is a magnified view taken from a selected area of FIG. 21.

At the start of phase four, carton cutter 10 is in a cutting position and remains in such a position until the user retracts knife 10 from the work piece following a cutting process. When the carton cutter 10 is retracted from the work piece, the frictional force (second external force) acting on the blade overcomes the opposite urging force of biasing member 66, pulling the blade (and the blade receptacle 60) forward. The blade assumes an extended position having dimension C shown in FIG. 21. Dimension C is greater than dimension B, but no greater than dimension A, and is often equal to dimension A. In conjunction with this forward movement, the follower 70 becomes dislodged and also moves forward. When the surface 74 of the follower 70 contacts surface 29 of the cam profile 30, the follower continues to rotate towards a reset position, as shown in FIG. 21 and FIG. 22. As soon as the blade is removed completely from the work piece, it is forced rearward into a closed position from the urging force of biasing member 66. FIG. 22 illustrates the alignment of follower 70 to cam profile 30 as it assumes a reset position. As follower 70 is retracted, surfaces 74 are in or near alignment with the upper surface 33 and lower surface 35 of the cam profile 30. The configuration of the profile ensures the rotation of follower 70 back to the closed position shown in FIG. 14 and FIG. 15. This phase completes the cycle until it is repeated.

At phase two, the carton cutter 10 assumes a first open position, and at phase four, the carton cutter 10 assumes a second open position. Except for the internal orientation of the follower 70, the first open position and the second open position are substantially identical. Thus, as explained above, dimension C is often equal to dimension A. As the user continues applying force and completes a cutting process, the blade of the carton cutter detaches from the cardboard. Upon release, the blade automatically retracts and places utility knife 10 into a closed position. Overall, the extension and retraction mechanism of the utility knife 10 composed of the rotatable follower 70 and cam profile 30 and their respective surfaces produces movement of the blade receptacle 60 that is somewhat like the movement produced by a ballpoint click pen.

The accompanying drawings only illustrate a carton cutter and its constituent parts, however, other types and styles are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first," "second," "upper," "lower" and similar terms may be used herein to modify various elements. These modifiers do not imply a spatial, sequential, or hierarchical order to the modified elements unless specifically stated.

The invention claimed is:

1. An improved carton cutter for cutting cartons with a retractable utility blade having an edge, the carton cutter comprising:

a first frame member having a cam profile;

a second frame member attached to said first frame member to form a housing; and a blade receptacle slidably engaged to said first frame member, said blade receptacle having (a) a blade carrier, (b) a biasing member for urging said receptacle rearward, (c) a latch for moving said blade receptacle forward, and (d) a follower with a plurality of surfaces having a configuration adapted to communicate with said cam profile (i) to maintain said blade receptacle in an extended position without force being applied to said latch, (ii) to enable said blade receptacle to move forwardly by frictional force against the force of the biasing member, as the blade cuts a carton, and (iii) enabling release of said blade receptacle upon termination of cutting, thereby enabling automatic retraction of said blade receptacle substantially into the housing instantly after cutting is complete;

wherein said follower has a plurality of surfaces, one pair of parallel surfaces, and two v-shaped surfaces located between said parallel surfaces; and wherein said parallel surfaces are parallel to said edge of said blade when said utility knife is in a retracted position and when said blade is mounted in said blade receptacle.

2. The carton cutter of claim 1, wherein said first frame member and said second frame member are pivotably connected to one another to form said housing.

3. The carton cutter of claim 1, wherein said follower has an hourglass shape.

4. The carton cutter of claim 1, wherein said plurality of surfaces of said follower comprises one pair of parallel surfaces, and two pairs of curved surfaces located between said parallel surfaces.

5. The carton cutter of claim 1, said second frame member further comprising a gripped cover formed of an elastomeric material.

6. The carton cutter of claim 1, wherein said blade carrier is integrally molded with said biasing member.

7. The carton cutter of claim 1, wherein said biasing member has a serpentine configuration.

8. The carton cutter of claim 1, said first frame member further comprising a blade guide at a front end of said first frame member, wherein said blade guide is positioned to support said blade receptacle.

9. The carton cutter of claim 8, wherein said blade guide is positioned to impede forward movement of said blade receptacle when said latch comes in contact with said rear of said blade guide.

10. The carton cutter of claim 1, wherein said first frame member comprises a dimple for holding said first frame member when separating said first frame member from said second frame member.

11. A carton cutter for cutting using a selectively attached blade having an edge, comprising:

a housing having a first frame member, a cam located on said first frame member, said cam having a cam profile;

a blade receptacle slidably engaged to said first frame member, said blade receptacle having a blade carrier and a rearward-urging biasing member;

a follower coupled to said blade receptacle, said follower adapted to move based on said cam profile;

wherein said blade carrier is adapted to shift into a cutting position after a first forward external force is applied to said blade carrier;

wherein said follower is adapted to rotate into a lodged position against said cam profile to restrict rearward movement of said blade carrier when said blade carrier is in said cutting position;

wherein said follower is held in said lodged position by both an upper surface of said cam profile and a lower surface of said cam profile;

wherein said follower has a plurality of surfaces, one pair of parallel surfaces, and two pairs of curved surfaces located between said parallel surfaces; and wherein said parallel surfaces are parallel to said edge of said blade when said utility knife is in a retracted position and when said blade is mounted in said blade receptacle.

12. The carton cutter of claim 11, wherein said blade carrier is adapted to shift into a retracted position after a second forward external force is applied to said blade carrier.

13. The carton cutter of claim 11, further wherein after said second forward external force is applied to said blade carrier, said follower is adapted to further rotate into a reset position against said cam profile to permit said blade carrier to shift into said retracted position.

14. The carton cutter of claim 11, further comprising a second frame member pivotably connected to said first frame member to form said housing.

15. The carton cutter of claim 11, wherein said follower has an hourglass configuration.

16. The carton cutter of claim 11, wherein said surfaces of said follower are adapted to communicate with said cam profile to rotate said follower when said blade receptacle is moved into a first open position.

17. The carton cutter of claim 16, wherein said surfaces of said follower are adapted to communicate with said cam profile to further rotate said follower when said blade receptacle is moved into a second open position.

18. The carton cutter of claim 17, wherein said surfaces of said follower are adapted to communicate with said cam profile to further rotate said follower when blade receptacle is moved into a retracted position.

19. An improved carton cutter for cutting with a blade having an edge, the carton cutter comprising:

a first frame member having a cam, said cam having a cam profile; and a blade receptacle having a rotatable follower, said follower being positioned against said cam profile;

wherein said follower is configured to rotate into an engaged position when said blade receptacle moves into a cutting position; and wherein said follower is configured to rotate into a reset position when said blade receptacle moves into a retracted position;

wherein said follower has a plurality of surfaces, one pair of parallel surfaces, and two v-shaped surfaces located between said parallel surfaces; and wherein said parallel surfaces are parallel to said edge of said blade when said utility knife is in a retracted position and when said blade is mounted in said blade receptacle.

20. The carton cutter of claim 19, said blade receptacle further having a finger latch.

21. The carton cutter of claim 19, said blade receptacle further having a blade carrier.

22. The carton cutter of claim 21, said blade receptacle further having a biasing member.

23. The carton cutter of claim 22, said biasing member having a first end and a second end, said first end being attached to said blade carrier and said second end being anchored to said first frame member.

24. The carton cutter of claim 19, wherein said follower has an hourglass configuration.

25. A carton cutter for use with a blade having an edge comprising:

a housing;

a sliding carrier member within said housing to hold said blade, said sliding carrier member adapted to slide between an extended position for cutting and a retracted position;

a cam located within said housing;

a follower, said follower and said cam adapted to communicate with one another to retain said blade in said extended position when cutting through a corrugated board and adapted to retract said blade instantly after said blade is no longer in contact with said corrugated board;

wherein said follower has a plurality of surfaces, one pair of parallel surfaces, and two surfaces located between said parallel surfaces, said two surfaces selected from the group consisting of: v-shaped surfaces and curved surfaces; and wherein said parallel surfaces are parallel to said edge of said blade when said utility knife is in a retracted position and when said blade is mounted in said blade receptacle.

* * * * *